US005441468A

United States Patent [19]

Deckers et al.

[11] Patent Number: 5,441,468

[45] Date of Patent: Aug. 15, 1995

[54] RESILIENTLY MOUNTED TREADMILL DECK

[75] Inventors: Stephen V. Deckers, Redmond; Russell F. Pasic, Seattle; Stanley Peterman, Jr., Kirkland, all of Wash.

[73] Assignee: Quinton Instrument Company, Bothell, Wash.

[21] Appl. No.: 315,666

[22] Filed: Sep. 30, 1994

Related U.S. Application Data

[63] Continuation of Ser. No. 205,538, Mar. 4, 1994, abandoned.

[51] Int. Cl.[6] ..... A63B 22/02

[52] U.S. Cl. ..... 482/54; 482/51; 198/841

[58] Field of Search ..... 482/54, 77, 51; 198/841

[56] References Cited

U.S. PATENT DOCUMENTS

| | | | |
|---|---|---|---|
| 2,239,076 | 4/1941 | Biedess | 198/841 |
| 3,319,767 | 5/1967 | Breternitz et al. | 198/841 |
| 3,427,019 | 2/1969 | Brown . | |
| 3,590,980 | 7/1971 | Bengtsson | 198/841 |
| 3,659,845 | 5/1972 | Quinton . | |
| 3,689,066 | 9/1972 | Hagen . | |
| 3,703,284 | 11/1972 | Hesen . | |
| 3,731,917 | 5/1973 | Townsend . | |
| 4,334,676 | 6/1982 | Schonenberger . | |
| 4,350,336 | 9/1982 | Hanford . | |
| 4,364,556 | 12/1982 | Otte . | |
| 4,445,683 | 5/1984 | Ogden . | |
| 4,614,337 | 9/1986 | Schonenberger . | |
| 4,616,822 | 10/1986 | Trulaske et al. . | |
| 4,635,927 | 1/1987 | Shu . | |
| 4,766,996 | 8/1988 | Gibson . | |
| 4,819,583 | 4/1989 | Guerra . | |
| 4,842,266 | 6/1989 | Sweeney, Sr. et al. . | |
| 4,886,266 | 12/1989 | Trulaske . | |
| 4,927,138 | 5/1990 | Ferrari . | |
| 4,938,473 | 7/1990 | Lee et al. . | |
| 4,959,040 | 9/1990 | Gardner et al. . | |
| 4,974,831 | 12/1990 | Dunham . | |
| 5,072,928 | 12/1991 | Stearns et al. . | |
| 5,081,991 | 1/1992 | Chance . | |
| 5,088,729 | 2/1992 | Dalebout . | |
| 5,100,127 | 3/1992 | Melnick et al. . | |
| 5,184,988 | 2/1993 | Dunham . | |
| 5,205,800 | 4/1993 | Grant . | |
| 5,207,622 | 5/1993 | Wilkinson et al. . | |
| 5,251,742 | 10/1993 | Campbell . | |
| 5,336,144 | 8/1994 | Rodden . | |

FOREIGN PATENT DOCUMENTS

| | | |
|---|---|---|
| 0196877 | 10/1986 | European Pat. Off. . |
| 0403924 | 12/1990 | European Pat. Off. . |
| 0504649 | 9/1992 | European Pat. Off. . |
| 2616132 | 12/1988 | France . |
| 2152825 | 8/1985 | United Kingdom . |
| 1567221 | 5/1990 | U.S.S.R. . |

*Primary Examiner*—Lynne A. Reichard
*Attorney, Agent, or Firm*—Andrew J. Beck; Montgomery W. Smith; Richard D. Allison

[57] ABSTRACT

A resilient treadmill deck having a plurality of rigid and elastomeric spacers interconnecting the deck of treadmill with a pair of side members that form the frame of the treadmill to dampen the noise and vibration caused by the operation of the treadmill as well as to dampen the noise created by the user of the treadmill while providing a resilient surface for the user of the treadmill.

25 Claims, 6 Drawing Sheets

RESILIENTLY MOUNTED TREADMILL DECK

This is a continuation of application Ser. No. 08/205,538 filed on Mar. 4, 1994 now abandoned

BACKGROUND OF THE INVENTION

This invention relates to treadmills and, more importantly, to an improved treadmill apparatus which is formed with a deck surface, supported by multiple elastomeric spacers that are resilient enough to minimize shock when the foot of an exerciser contacts the treadmill surface but rigid enough not to interfere with the normal walking, jogging or running motions of the user.

Treadmills utilize an endless moving belt that allows an individual to walk, jog or run in place. Treadmills are useful not only for exercise purposes but also for rehabilitation programs and medical testing such as the popular "stress test." There is also a demand for treadmills in indoor health clubs since many clubs are not able to build a running track and the use of treadmills provides the capability for a well rounded exercise program in smaller health clubs.

Treadmills traditionally are formed with an endless belt which travels over a supporting surface such as a rigid plate so that the belt can withstand the weight of the individual using it. The use of a rigid support plate forms an underlying rigid surface that can create various injuries such as a "stone bruise" or "shin splints" because of its hard, unyielding surface. Another possible way of supporting the belt is to provide rollers under the belt. This construction is not totally desirable because the rollers provide an uneven exercise surface.

Thus, exercising on a treadmill with a rigid support surface underneath the belt is similar to exercising on a hard surface because of the impact on the feet of the user. This tends to exert undue strain on the legs and is a common cause of leg problems for joggers or runners and is particularly bothersome for patients who are undergoing a rehabilitation program.

Several solutions to this problem are set forth in the prior art. For example, U.S. Pat. No. 4,350,336 to Hanford provides a treadmill having a frame to which rollers are attached which carry an endless treadmill belt. The belt moves around a platform disposed beneath the running portion of the belt. The platform is supported by longitudinally oriented platform rails which are supported at the rear end thereof by a lateral frame member which is rigidly secured to the frame. The platform is supported midway along the forward end thereof by a shock absorbing member which is movably attached to the longitudinal rails. The shock absorbing member may be moved longitudinally along the frame to adjust the location of the shock absorbing member. The shock absorbing member in the Hanford device absorbs the shock directly from the platform as a user exercises on the treadmill belt.

In a commercially available device sold by Life Fitness of Franklin Park, Ill., U.S.A., the forward and rear ends of the platform are fixedly connected to the frame of the treadmill with two pairs of rigid elastomeric spacers. A pair of spaced apart shock absorbing members are located along the bottom of a pair of rigid bracket members which extend between each of the platform rails in an effort to cushion the impact of the user's feet on the platform of the treadmill.

The assignee of the present invention has also sold and marketed high end treadmills under the names MEDTRACK and CLUBTRACK for use in physicians'offices and health clubs for many years.

Other known approaches to solving this problem vary from a relatively simple use of an air cell containing surface underneath the treadmill belt as disclosed in U.S. Pat. No. 3,689,066 granted to Hagen to a relatively complex suspension system consisting of various lever arms and shock absorbers as disclosed in U.S. Pat. No. 5,184,988 granted to Dunham.

Another problem related to the use of treadmills arises from the noise and vibrations created during the use of the treadmill. The motors used in most treadmills create a noticeable amount of noise and vibrations during use. This noise and vibration created by the motor may then be magnified by the treadmill deck, particularly in treadmills where the deck is rigidly mounted to the frame of the treadmill. Therefore, the combination of the noise and vibrations created during the use of the treadmill and the noise created by the contact between the feet of the user and the treadmill make the use of treadmills undesirable in many situations.

Despite the foregoing attempts to provide an effective mechanism to cushion the impact of the user's feet on the belt of a treadmill, a need remains for a simple structure which effectively cushions the impact of the user's feet on the belt of a treadmill while also significantly reducing the noise and vibrations created during the use of the treadmill.

SUMMARY OF THE INVENTION

It is, therefore, an object of the present invention to provide a stable, flat running surface for a treadmill having a shock absorbing mechanism to cushion the impact of the user's feet on the belt of the treadmill.

It is another object of the present invention to provide a surface which disperses the force from the impact of the user's feet on the treadmill across a wide surface area to reduce the noise created during the use of the treadmill.

It is yet another object of the present invention to provide a surface which dampens the vibrations and noise created by the operation of the motor of the treadmill to reduce the overall operating noise of the treadmill.

In general, the present invention consists of a generally conventional treadmill having an endless treadmill belt, the uppermost side of which is adapted to form a flat surface capable of supporting an individual. A substantially rigid treadmill deck underlies the uppermost side of the treadmill belt and extends beyond the lateral sides of the treadmill belt. The treadmill deck and belt are supported by a rigid frame which also supports and houses the motor and other components of the treadmill.

In a preferred form of the present invention, the frame is an elongate and rigid support structure with an inwardly extending support surface thereon. The treadmill deck is interconnected with and supported by the frame using a plurality of spaced apart elastomeric spacers. The elastomeric spacers are preferably located in spaced apart alignment along the lateral edge of the treadmill deck to provide a cushioned contact surface between the treadmill deck and the frame.

In the more preferred arrangement of the present invention, the elastomeric spacers are used in combination with a pair of rigid fasteners that are located along the rear end of the treadmill deck. It has been found that the use of a pair of rigid spacers along the rear end of the treadmill deck functions to minimize the user induced shearing forces on the elastomeric spacers placed between the deck and frame. In prior treadmills which incorporated rigid spacers along the entire length of the treadmill deck, the noise and vibration created by the motor was believed to be amplified by the treadmill deck. The elastomeric spacers are located on the treadmill deck along the sides of the treadmill belt and are preferably evenly spaced forwardly of the rigid spacers.

Therefore, the combination of the rearwardly located rigid spacers and the forwardly located elastomeric spacers functions to dampen the noise and vibration caused by the operation of the motor as well as the remaining noises associated with the use of the treadmill by the user while providing an impact surface for the user which is not as rigid as prior surfaces.

An advantage of the treadmill of the present invention is that it is noticeably quieter than prior treadmills sold by the assignee of the present invention.

Another advantage of the present invention is that the use of rigid spacers between the deck and frame minimize undesirable shear forces in the elastomeric spacers placed along the length of the frame. At the same time the elastomeric spacers dampen the noise and vibration associated with the use of the treadmill.

Yet another advantage of the present invention is that the design of the elastomeric spacers significantly reduces the likelihood that the elastomeric spacer will form a compression set.

A further advantage of the treadmill of the present invention is that the improved treadmill deck is durable and easy to assemble.

Other advantages of the present invention will become apparent from the preferred form of the present invention which is more fully described below.

DETAILED DESCRIPTION OF THE PREFERRED EMBODIMENT

Figure 1:
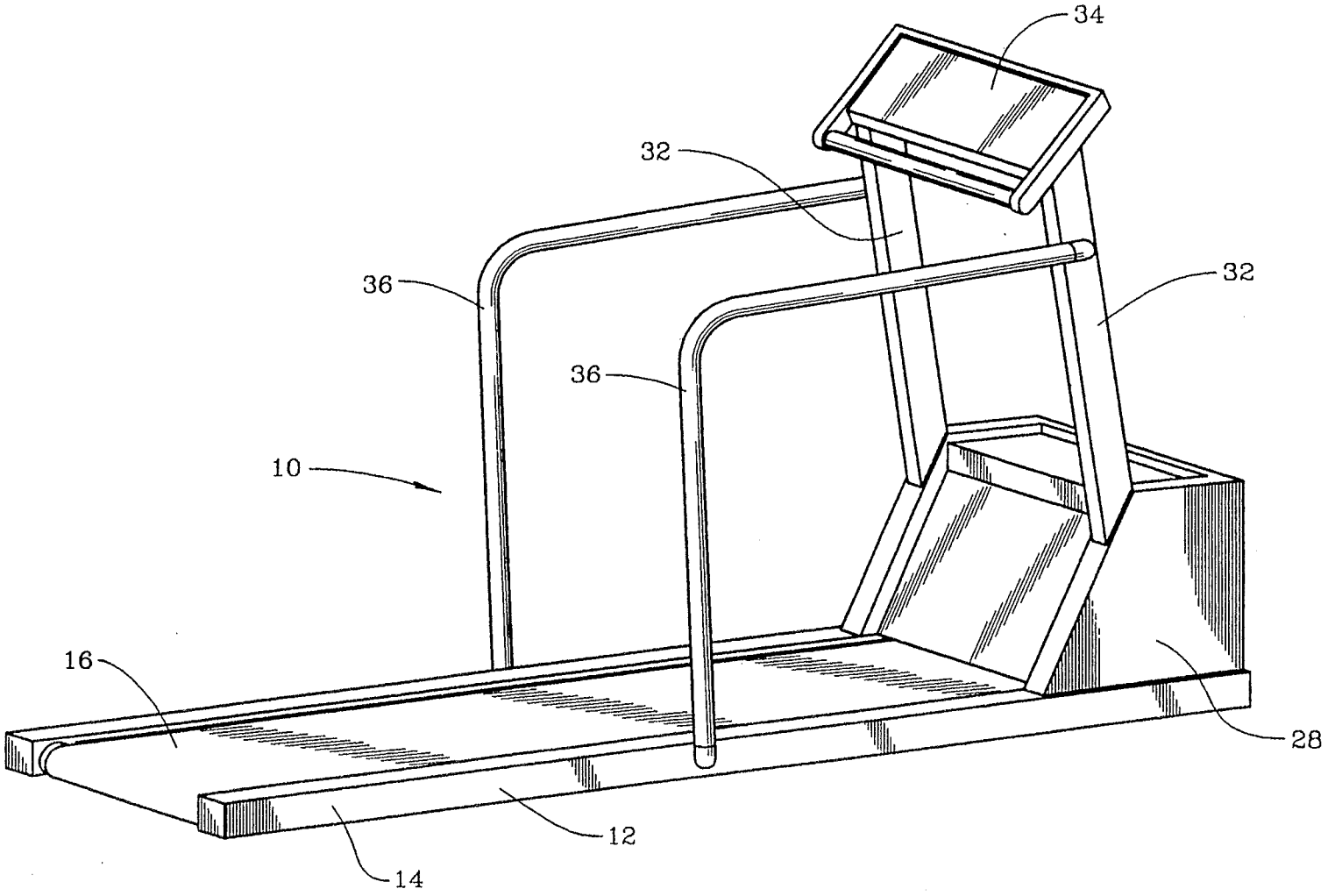
FIG. 1 is a side perspective view of a treadmill incorporating the improved treadmill deck of the present invention.
Figure 3:
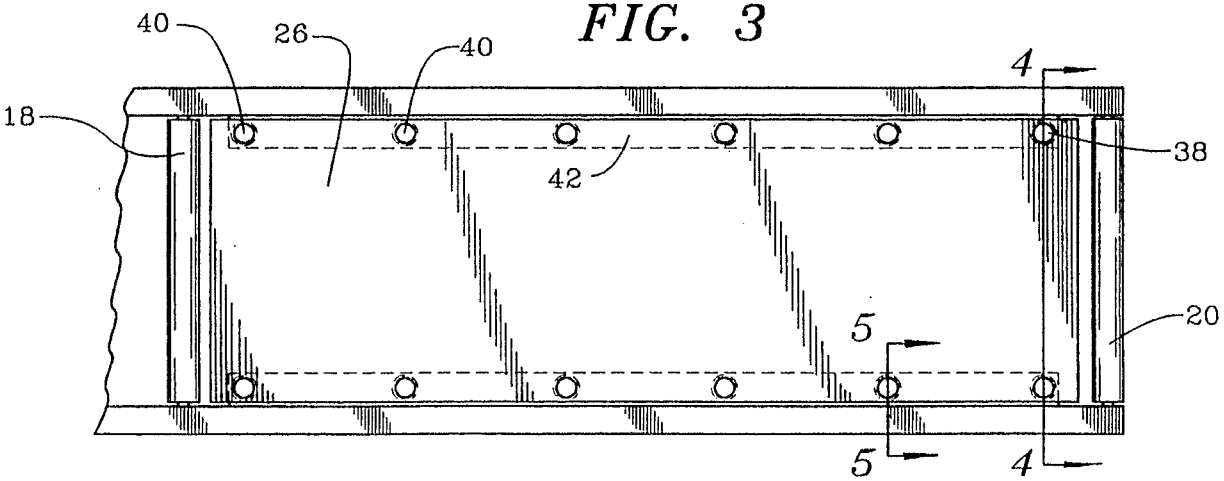
FIG. 3 is a top diagrammatic view of the deck portion of the treadmill of the present invention with the belt removed.

Referring now to the drawings, a treadmill of the type contemplated for use with the present invention is shown in FIG. 1 and referred to therein generally as treadmill 10. The treadmill 10 generally includes a frame 12 having a pair of generally horizontally disposed and spaced apart side rails 14 which extend along the entire lengthwise dimension of the treadmill 10. An endless belt 16 is disposed about the front and rear rollers, 18 and 20 respectively, as shown in FIG. 3. The front and rear rollers, 18 and 20, are interposed between the pair of elongate side rails 14 which form the sides of the frame 12. The endless belt 16 includes an upper reach or run surface 22 on which the user walks or runs and a lower reach surface. A panel surface or deck 26 is positioned between the upper surface 22 and lower surface of the belt 16 to provide support for the lower belt 16 to enable the user of the treadmill to be supported by the deck 26 as the user walks or runs on the treadmill 10.

The forward end of the treadmill 10 further includes a housing or hood cover 28 which encloses the motor 30, drive mechanism and other conventional operational components of the treadmill 10. A pair of upwardly extending support members 32 extend upwardly from the frame 12 and hood cover 28 to support a control panel 34 therebetween. A pair of support rails 36 also extend rearwardly from the support members 32 to provide optional side support for the user. The support rails 36 are preferably oriented generally parallel to the side rails 14 of the frame 12 and are attached thereto approximately midway along the lengthwise dimension of the side rails 14.

As thus far described, these components of the treadmill 10 are substantially conventional and are present in various forms on commercially available treadmills. Therefore, these components may take many forms without affecting the present invention as described in general previously and described in detail below.

Figure 2:
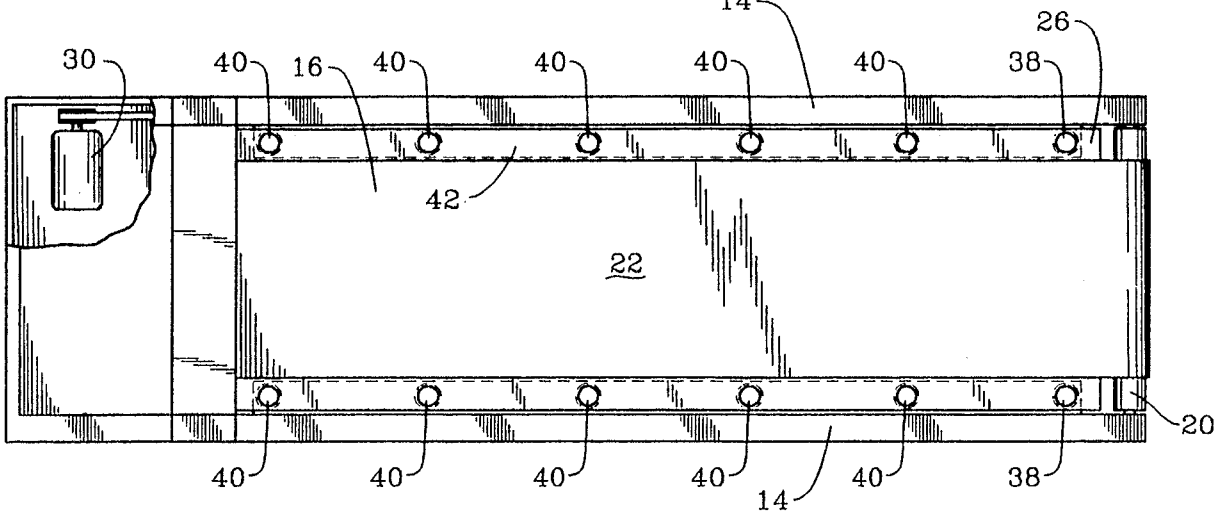
FIG. 2 is a top diagrammatic view of the treadmill of the present invention showing the location of the spacers of the present invention.

As best shown in FIG. 3, the treadmill deck 26 is preferably a generally flat rectangularly shaped member having an outer surface formed of a composite material which is designed to reduce the friction between the deck 26 and the belt 16. The interior of the deck 26 is preferably made of a pressed or composite wood to reduce the weight of the deck while maintaining the strength and durability thereof. As shown in the drawings, the surface of the deck 26 is wider than the belt 16 while having a lengthwise dimension which is slightly less than the length of the belt 16 to accommodate the front and rear rollers, 18 and 20 respectively, adjacent to the ends thereof. As shown in FIG. 2, the lengthwise perimeter of the deck 26 includes the rigid and elastomeric spacers, 38 and 40 respectively, attached thereto. The deck 26 is positioned along and generally flush with the top inner surface of the side rails 14.

Figure 4:
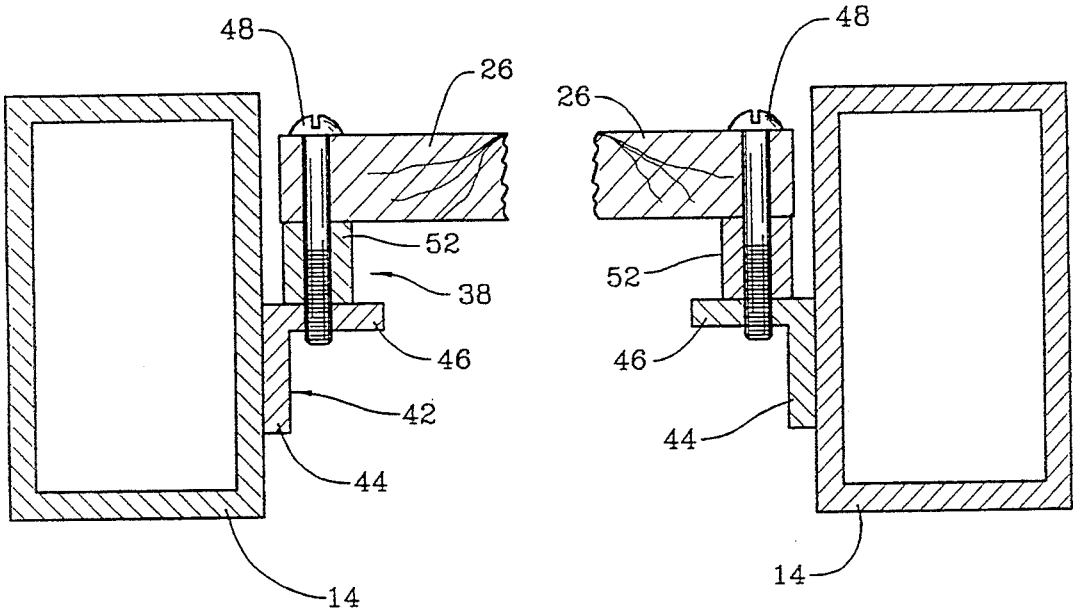
FIG. 4 is a cross-sectional view of the treadmill of the present invention taken generally along lines 4—4 of FIG. 3.
Figure 5:
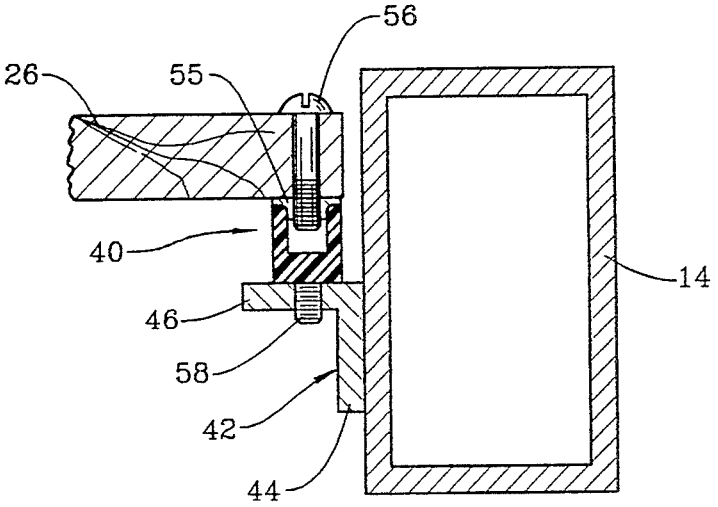
FIG. 5 is an enlarged cross-sectional view of the treadmill of the present invention taken generally along lines 5—5 of FIG. 3.

As shown in FIGS. 4 and 5, the side rails 14 are preferably formed of an elongate metal tubing such as a steel tubing having a generally rectangularly shaped cross section. The inner sides of the side rails 14 preferably include a pair of metal angle iron supports 42 welded or otherwise affixed thereon. The angle supports 42 preferably include a first surface 44 which is parallel to the inner side of the side rail 14 and a second surface 46 which extends perpendicularly inwardly from the side surface of the side rail 14. As shown in the drawings, the angle iron supports 42 preferably extend along the lengthwise dimension of the side rails 14 adjacent to the deck 26 to provide longitudinal support for the deck 26.

As shown in FIG. 4, the rigid spacers 38 preferably consist of elongate bolts 48 which extend downwardly from the top surface of the deck 26, through an opening in the deck 26, and are received in a threaded opening in the second surface 46 of the angle iron support 42. One or more metal washers 52 may be preferably positioned between the bolt 48 and the top surface of the deck 26 and the bottom surface of the deck 26 and the angle iron support 42 to ensure that the components are rigidly secured and spaced apart from each other. The thickness of the metal washers 52 is chosen to approximate the thickness of the elastomeric spacers 40 between the deck 26 and the angle iron support 42. As shown in FIGS. 2 and 3 and briefly described above, the rigid spacers 38 are located near the rear end of the deck 26 along each side rail 14. By positioning the rigid spacers 38 rearwardly of the elastomeric spacers 40, the forward portion of the deck 26 flexes in response to the compression of the elastomeric spacers 40 while the rigid spacers 38 rigidly connect the deck 26 to the frame 12. The rigid spacers 38 also limit the transverse movement of the deck 26 with respect to the side rails 14 of the frame 12 to provide lateral or transverse stiffness to the treadmill so that the shearing of the elastomeric spacers 40 is prevented and the proper positioning of the belt 16 about the front and rear rollers 18 and 20 is maintained. The rigid spacer 38 may be alternately affixed to the deck 26 and angle iron support 42 with a nut or other member threadedly received on the end thereof or the rigid spacer 38 may be formed as a one-piece member.

As best shown in FIGS. 2 and 3, the preferred form of the present invention includes two rigid spacers 38 and ten elastomeric spacers 40. The elastomeric spacers 40 are evenly spaced apart forwardly of the rigid spacers 38 along the periphery of the deck 26. It is believed that this orientation allows the noise created by the user and the operation of the motor 30 and belt 16 to be dispersed rearwardly along the deck 26 of the treadmill while it is being suppressed and dampened by the elastomeric spacers 40.

Figure 6A:
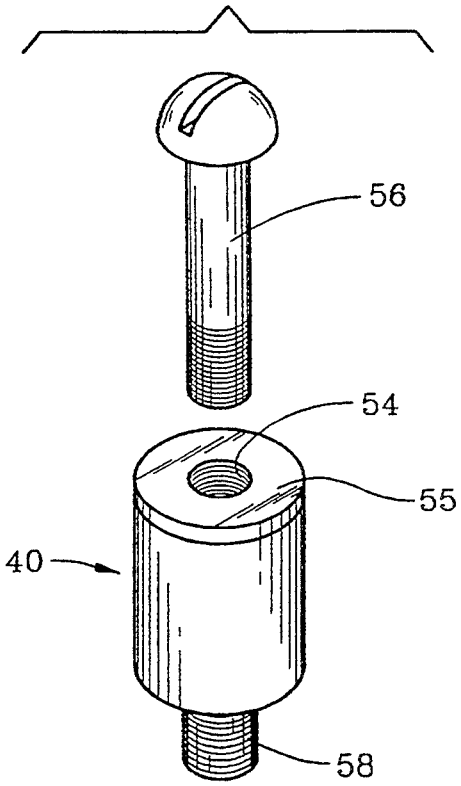
FIGS. 6A and 6B are an enlarged perspective and cross-sectional side views of the elastomeric spacer assembly of the present invention.
Figure 6B:
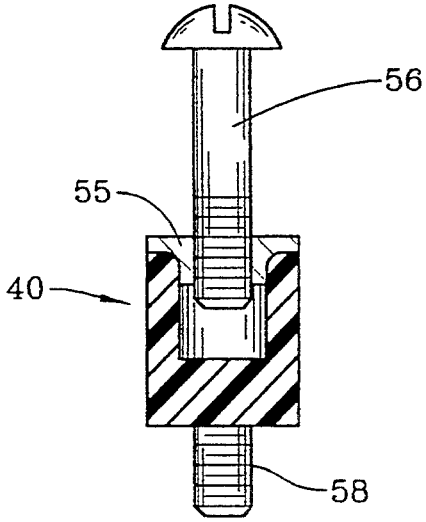

FIGS. 6A and 6B illustrate the preferred form of a commercially available elastomeric spacer 40. The elastomeric spacer 40 is preferably a generally cylindrical member formed of a compressible material such as an elastomeric neoprene or rubber and has a durometer of approximately 30 to 40A. The top portion of the elastomeric spacer 40 includes a threaded recess 54 extending downwardly therein. The threaded recess 54 is formed by a tapped insert 55 molded or otherwise fixedly received therein so that the recess 54 reliably receives the threaded bolt 56 therein. The bottom portion of the elastomeric spacer 40 preferably includes the bottom portion of a threaded stud 58 extending therefrom. In this preferred form of the invention, the head of the threaded stud 58 is retained in the body of the elastomeric spacer 40 so that the threaded stud 58 is fixedly positioned with respect to the body of the elastomeric spacer 40. As best shown in FIG. 5, the elastomeric spacer 40 is retained between the deck 26 and the second surface 46 of the angle iron support 42. The threaded bolt 56 preferably extends downwardly from the top of the deck 26 through the hole in the deck 26 and is threadedly received in the threaded recess 54 on the top surface of the elastomeric spacer 40. The threaded stud 58 on the bottom surface of the elastomeric spacer is threadedly received in a threaded hole in the second surface 46 of the angle iron support 42 so that the resilient body portion of the elastomeric spacer 40 is compressibly received between the deck 26 and the second surface 46 of the angle iron support 42. It should be noted that the force dampening characteristics of the compressed elastomeric spacer 40 are believed to be more preferable than the extension and retraction created with the use of springs or other trampoline type configurations because the springs have a greater tendency to create an undesirable bouncing sensation for the user on the treadmill deck 26. As with the bolt 48 of the rigid spacer 38 described above, the threaded stud 58 of the elastomeric spacer 40 may receive a nut on the bottom end thereof, and one or more washers may be positioned between the respective components without departing from the scope of the present invention.

Additionally, the elastomeric spacer 40 is much less likely to suffer from the permanent compression set of the spacer than prior spacer designs. In prior spacer designs, a compressible donut or washer surrounds a bolt or similar member which is fixed at one end to the frame of the treadmill. After exposure to heavy loads or prolonged use, the compressible donut would maintain a permanent compression set which caused the deck to feel loose or sloppy. This then requires a service call to correct because the bolts must be adjusted and/or the compressible donuts must be replaced.

In operation, the user typically contacts the belt 16 near the second or third set of elastomeric spacers 40. Therefore, the force of the user's foot initially compresses the forward elastomeric spacers 40 which have a slightly greater ability to compress than the rearwardly positioned elastomeric spacers 40. Additionally, the combination of the deck 26, the rigid spacers 38 and the side rails 14 are believed to cause the force created by the foot of the user to also be dispersed rearwardly from the area of contact and dampened by the remaining elastomeric spacers 40. The use of the combination of the rearwardly positioned rigid spacers 38 and the forwardly positioned elastomeric spacers 40 also dampen the vibration and noise created during the operation of the motor 30 while maintaining the structural integrity of the frame 12 and deck 26 of the treadmill 10.

Figure 7:
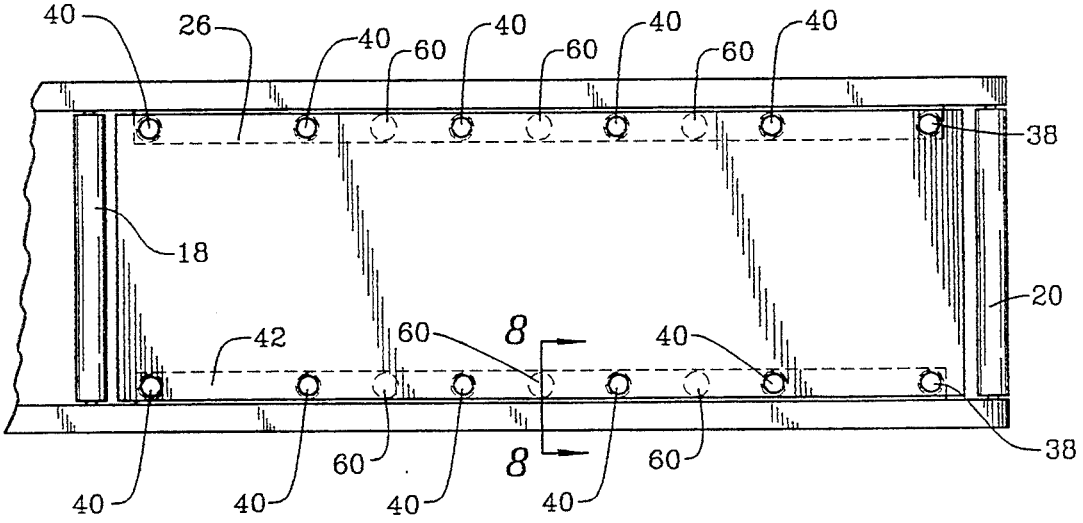
FIG. 7 is a top diagrammatic view of the deck portion of an alternate embodiment of the present invention showing the location of the spacers in the embodiment.
Figure 8:
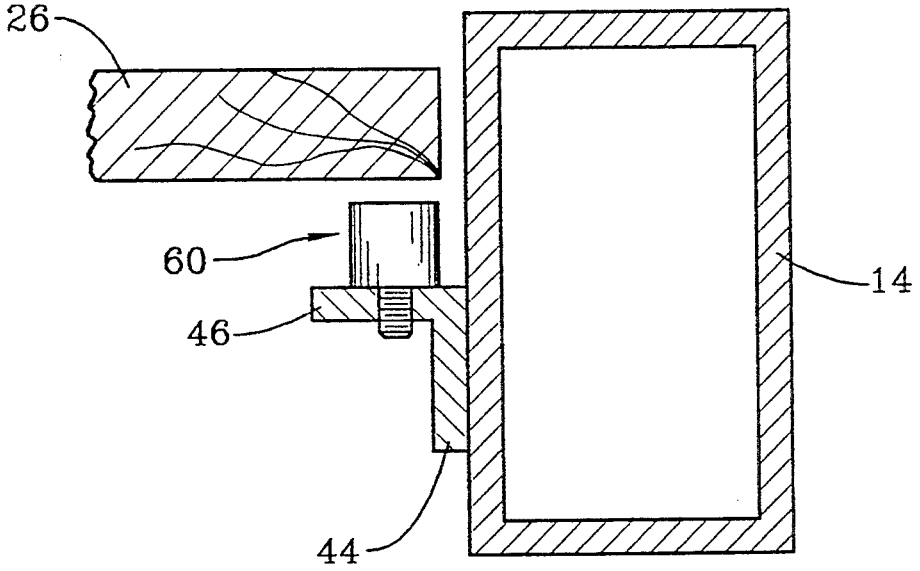
FIG. 8 is an enlarged cross-sectional view of the embodiment shown in FIG. 7 taken generally along lines 8—8 of FIG. 7.
Figure 9:
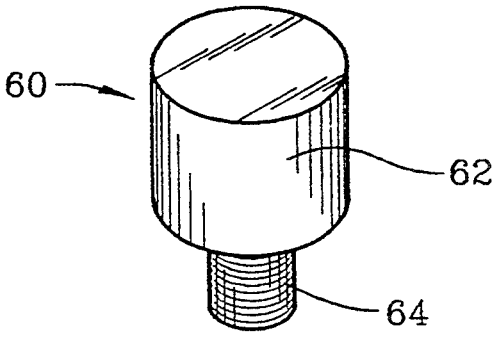
FIG. 9 is an enlarged perspective view showing the short elastomeric spacers of the alternate embodiments.

FIGS. 7–9 are illustrative of a further preferred form of the present invention. In this embodiment, the treadmill 10 preferably includes the rigid and elastomeric spacers, 38 and 40, as well as a plurality of short spacers 60. As shown in FIG. 7, the short spacers 60 are preferably positioned along the periphery of the deck 26 and between certain of the elastomeric spacers 40. In the most preferred form of this embodiment, the short spacers 60 and elastomeric spacers 40 are alternately positioned along the periphery of the deck 26 near the middle lengthwise portion of the deck 26. Therefore, the portion of the deck 26 which is most likely to receive the impact from the user's feet during use includes both the short spacers 60 and the elastomeric spacers 40 along the periphery thereof.

The short spacers 60 preferably include a cylindrically shaped body portion 62 and a threaded stud portion 64 as shown in FIG. 9. The body portion 62 is preferably formed of a compressible or elastomeric material such as neoprene or rubber. The threaded stud portion 64 extends downwardly from the bottom of the body portion 62. As shown in FIG. 8, the height of the body portion 62 is chosen so that the top surface of the short spacer 60 is normally spaced apart from the bottom surface of the deck 26. As with the threaded stud 58 of the elastomeric spacer 40, the threaded stud portion 64 of the short spacer 60 is threadedly received in a threaded hole in the second surface 46 of the angle iron support 42.

Figure 10:
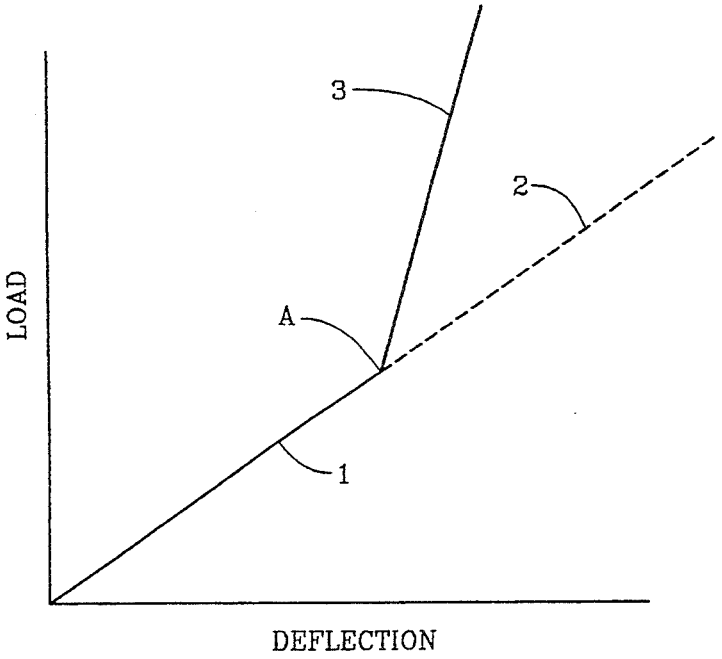
FIG. 10 is a graphical representation of the stiffness of the deck during typical operation in response to an increased weight or load on the deck of the alternate embodiment.

FIG. 10 depicts the effect of using the combination of elastomeric spacers 40 and short spacers 60 to resiliently mount the deck 26 on the frame 12 of a treadmill 10. During normal use of the treadmill 10 of the embodiment of the present invention shown in FIGS. 1–6, the comparison of an increasing load or weight with the compression of the elastomeric spacers 40 is generally a straight line; i.e., as the load increases there is a proportional increase in the deflection of the elastomeric spacer 40. This is indicated by portions 1 and 2 of the lines shown in FIG. 10. Additionally, the stiffness of the elastomeric spacer 40 relates to the resiliency of the deck 26 by providing proportional cushioning to the user under the normal range of loads.

During normal use of the embodiment shown in FIGS. 7–9, as the load or weight increases there is a proportional increase in the deflection of the elastomeric spacer 40 until the load or weight reaches point A as indicated in FIG. 10. When the load reaches point A in FIG. 10, the body portion of the elastomeric spacer 40 is compressed so that the top surface of the body portion 62 of the short spacer 60 is in contact with the bottom surface of the deck 26. As the load or weight applied to the deck 26 increases beyond the load indicated at point A, there is an increased resistance to the deflection of the deck 26 due to the additional stiffness provided by the short spacers 60. This increased resistance is indicated by portion 3 of the lines shown in FIG. 10.

The combination of elastomeric spacers 40 and short spacers 60 provides a treadmill 10 having a deck 26 which is cushioned differently for lower and higher loads. An advantage of this is that the elastomeric spacers 40 will not wear out as quickly when they are combined with the short spacers 60 because the elastomeric spacers 40 will function in combination with the short spacers 60 when the deck 26 is under a heavy load. Additionally, when a user is running on the treadmill, the compression of the elastomeric spacers 40 may be chosen so that the heaviest portion of the impact is absorbed by both the elastomeric spacers 40 and the short spacers 60 while the initial and later portions of the impact will be absorbed by the elastomeric spacer 40 alone. Therefore, if a treadmill is to be used in a situation where heavier loads are commonly encountered, the present invention provides the manufacturer of the treadmill with the option of providing a different combination of spacers than if typical or lighter loads are commonly encountered without significant design changes in the treadmill.

As is conventional, the treadmill frame and deck of the present invention may include a means for adjusting the incline of the running surface or various other features or components which are not necessary for an understanding of the operation, structure or importance of the present invention. Additionally, the conventional components of a treadmill as described herein may also be modified without departing from the scope of the present invention which is defined by the claims set forth herein.

What is claimed is:

1. An exercise device comprising;

an elongate frame having a pair of generally elongate and parallel side members;

one or more rollers extending generally between said side members;

a deck member operatively positioned between said side members and said one or more rollers, said deck member having a width dimension extending between said side members and a lengthwise dimension extending generally parallel to said side members and wherein said deck member includes a forward end portion and a rearward end portion;

a plurality of generally rigid spacers extending between said deck member and said side members, and said rigid spacers being positioned generally adjacent said rearward end portion of said deck member; and a plurality of compressible spacers extending between said deck member and said side members and said compressible members being positioned forwardly of said rigid spacers.

2. The device of claim 1 wherein said side members form the frame of said device, and said frame operatively supports a plurality of support members and a control panel thereon.

3. The device of claim 1 wherein said one or more rollers include a forward roller operatively connected to a motor for rotating a belt about said deck member and a rear roller interconnected between said side members.

4. The device of claim 1 wherein said compressible spacer includes a flexible body portion positioned between said deck member and at least a portion of one of said side members.

5. The device of claim 1 wherein said side members include lip members thereon which extend inwardly toward each other when said side members are oriented parallel to each other to form part of said frame.

6. The device of claim 5 wherein said compressible spacers are positioned between said deck member and said lip members.

7. The device of claim 5 wherein said rigid spacers rigidly interconnect said deck member and said rearward end portion of said lip members.

8. The device of claim 1 wherein said deck member and said side members are operatively interconnected by more of said compressible spacers than said rigid spacers.

9. The device of claim 1 wherein a further plurality of spacers are positioned between said deck member and said side members and wherein said further spacers are spaced apart from one of said deck member or one of said side members and operatively connected to the other of said deck member or one of said side members.

10. A treadmill comprising;

an elongate frame having a pair of generally elongate and parallel side members;

one or more rollers extending between and oriented generally perpendicular to said side members wherein one of said rollers is a rear roller;

a belt movably positioned about said one or more rollers;

a deck member positioned between said side members and having a width dimension between said side members and a rear end portion generally adjacent to said rear roller, said deck member forming an underlying support surface for at least a portion of said belt;

a plurality of generally short spacers operatively extending between said deck member and one of said side members wherein said short spacers are spaced apart from one of said deck member or one of said side members and operatively connected to the other of said deck member or one of said side members; and a plurality of compressible spacers operatively extending between said deck member and one of said side members.

11. The treadmill of claim 10 wherein said side members further include inwardly extending lip members thereon, and a body portion of said compressible spacers compressibly extends between said lip members and said deck member.

12. The treadmill of claim 10 wherein said compressible spacers include a top portion having a recess therein and a bottom portion having a downwardly extending stud member thereon and wherein said recess in said compressible spacer is sized to receive a bolt therein which extends through one of a plurality of laterally spaced apart openings in said deck member.

13. The treadmill of claim 12 wherein said stud member of said compressible spacer is sized to operatively contact one of said side members.

14. The treadmill of claim 10 wherein a plurality of rigid spacers are positioned between said deck member and said side members.

15. The treadmill of claim 14 wherein said rigid spacers are operatively positioned generally along said rear end portion of said deck member and said short spacers, and said compressible spacers are positioned forwardly thereof.

16. A treadmill comprising;

an elongate frame having a pair of generally elongate and parallel side members and said side members each having inner surfaces thereon with lip members extending inwardly therefrom;

a plurality of rollers extending between and oriented generally perpendicular to said side members wherein said plurality of rollers include front and rear rollers;

a belt movably positioned about said plurality of rollers;

a deck member positioned between said side members and having a width dimension between said side members and forward and rearward end portions generally adjacent to said front and rear rollers, said deck member forming an underlying support surface for at least a portion of said belt and further including a plurality of spaced apart openings therein wherein said openings are aligned on said deck member generally adjacent to said side members and aligned with said lip members;

a plurality of generally rigid spacers extending through a plurality of openings in said deck member wherein said openings are aligned with openings in said lip members on said side members; and a plurality of compressible spacers having a portion thereof extending through a further plurality of openings in said deck and said compressible spacers further including a body portion flexibly positioned between said deck member and said lip members of said side members.

17. The treadmill of claim 16 wherein said deck member and said side members each include top surfaces, and said top surfaces are generally flush with each other.

18. The treadmill of claim 16 wherein more compressible spacers interconnect said deck member to said lip members than said rigid spacers.

19. The treadmill of claim 16 wherein said compressible spacers are positioned forwardly of said rigid spacers along said deck member and said side rails.

20. The treadmill of claim 16 wherein a plurality of short spacers are operatively positioned between said deck member and said side members.

21. The treadmill of claim 20 wherein said short spacers are spaced apart from said deck member and operatively connected to said side members.

22. The treadmill of claim 20 wherein said short spacers are sized to contact said deck member upon compression of one or more of said compressible spacers.

23. The treadmill of claim 16 further including a plurality of short spacers oriented along the periphery of said deck member.

24. A treadmill comprising;

an elongate frame having a pair of generally elongate and parallel side members;

one or more rollers extending between and oriented generally perpendicular to said side members;

a belt movably positioned about said one or more rollers;

a deck member positioned between said side members and having a width dimension between said side members and forward and rearward end portions, said deck member forming an underlying support surface for at least a portion of said belt and wherein said deck member is deflectable between at least first and second positions;

a plurality of short spacers operatively extending between said deck member and one of said side members, said short spacers being sized to be spaced apart from one of said deck member or one of said side members in said first position of said deck member and operatively contacting said deck member and said one of said side members in said second position of said deck member; and a plurality of compressible spacers operatively extending between said deck member and one of said side members.

25. The treadmill of claim 24 wherein said compressible spacers operatively contact said deck member and one of said side members in said first and second position of said deck member.

* * * * *